US006137670A

United States Patent [19]

West et al.

[11] Patent Number: 6,137,670

[45] Date of Patent: Oct. 24, 2000

[54] REPLACEABLE ELECTRICAL IONIZER MODULE

[75] Inventors: Robert J. West, Alta Loma; Alejandro Alvizo Hernandez, Whittier, both of Calif.

[73] Assignee: Desco Industries, Inc., Walnut, Calif.

[21] Appl. No.: 09/252,315

[22] Filed: Feb. 18, 1999

[51] Int. Cl.[7] ..... H01T 23/00

[52] U.S. Cl. ..... 361/213; 361/231

[58] Field of Search ..... 361/212–215, 361/229–235

[56] References Cited

U.S. PATENT DOCUMENTS 4,734,580 3/1988 Rodrigo et al. ..... 250/324

5,055,963 10/1991 Partridge ..... 361/231

*Primary Examiner*—Michael J. Sherry

*Attorney, Agent, or Firm*—Oppenheimer Wolff & Donnelly LLP

[57] ABSTRACT

A replaceable electrical ionizer cartridge or module including a support platter having a central air passage opening therethrough and at least two emitter points supported by the support platter so as to extend into the opening. At least one electrical connector is supported by the support platter and is electrically connected to at least one of the emitter points. Two levers are pivotally attached to the platter at an end thereof. To install the module in the ionizer housing the platter is inserted in through a slot in the housing so that side edges of the platter engage in guide structure in the housing. The platter is then slid along the guide structure and when the platter is nearly fully inserted in the housing, the guide levers are pushed towards the housing. This causes the levers to bias against the housing, pushing the platter into the housing such that the connector(s) engages with one or more corresponding electrical connectors in the housing. The module is thereby in an operative position in the housing with the air passage opening aligned with the ionizer fan. When the ionizer points become dirty, the module is simply removed from the housing by pulling on the levers and then pulling the platter fully out of the opening. The emitter points are cleaned at a location remote from the work site of the ionizer and the module reinserted. Alternatively, a similar second module with clean emitter points is inserted into the housing.

48 Claims, 13 Drawing Sheets

FIG. 2
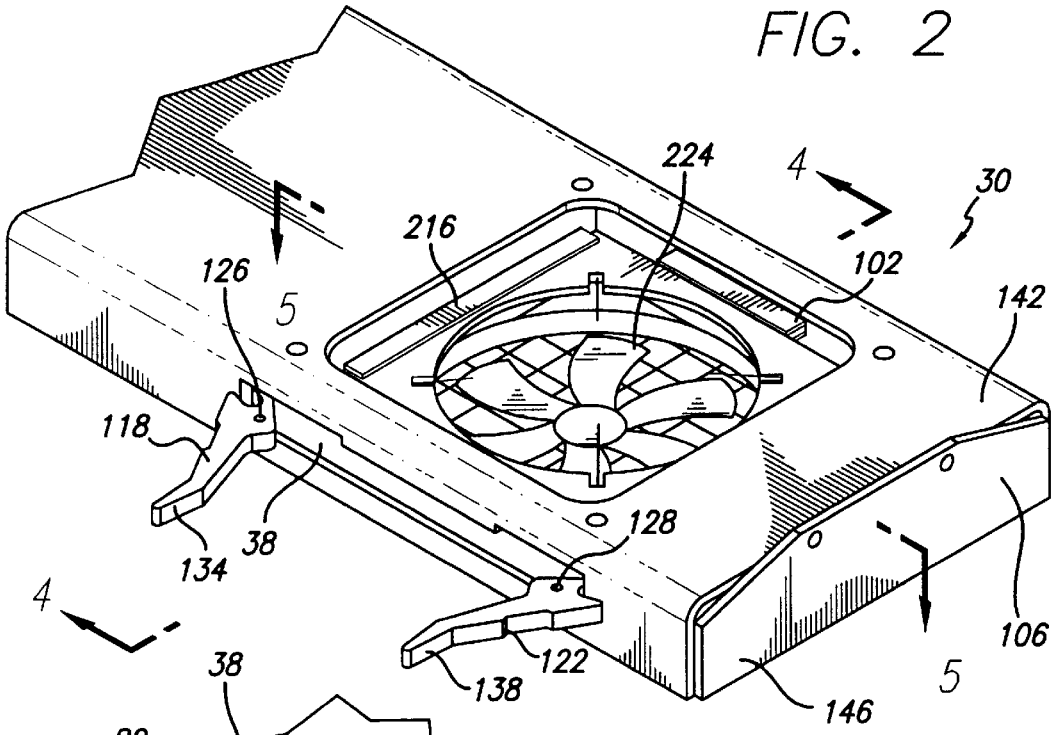
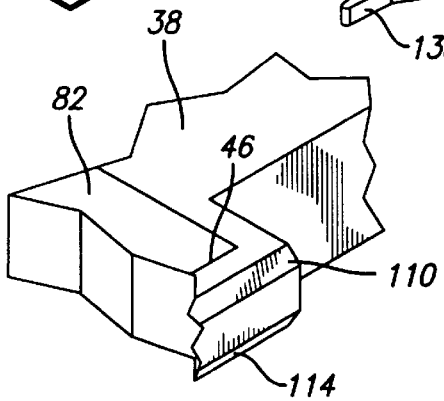
FIG. 3
FIG. 4
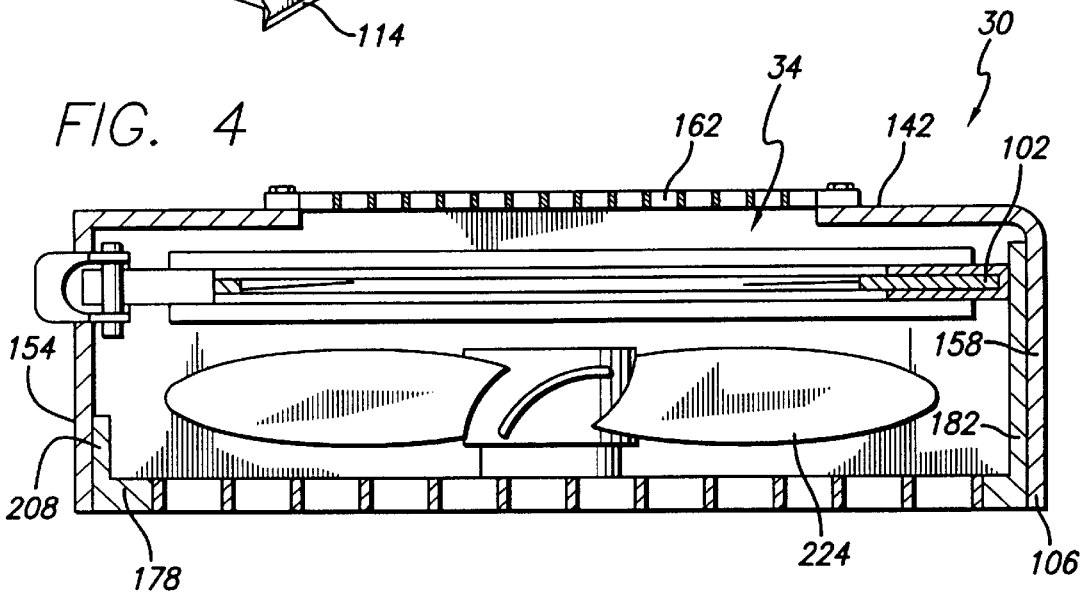

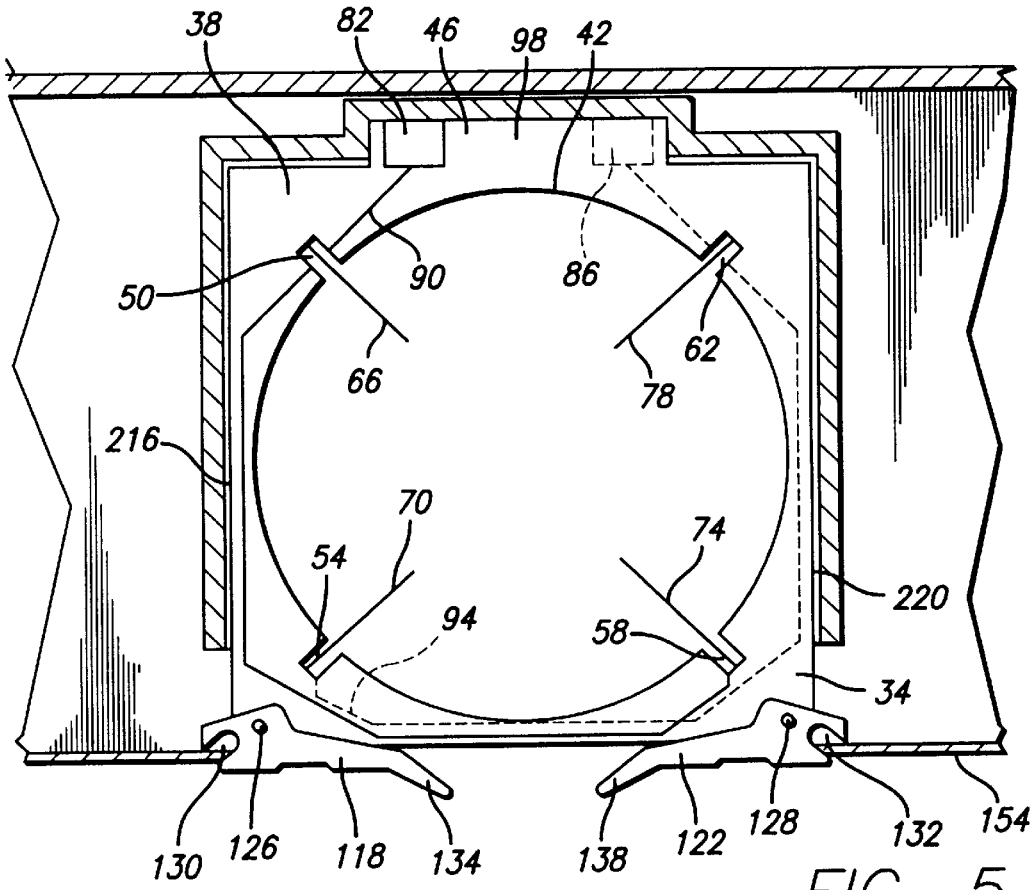
FIG. 5
FIG. 6
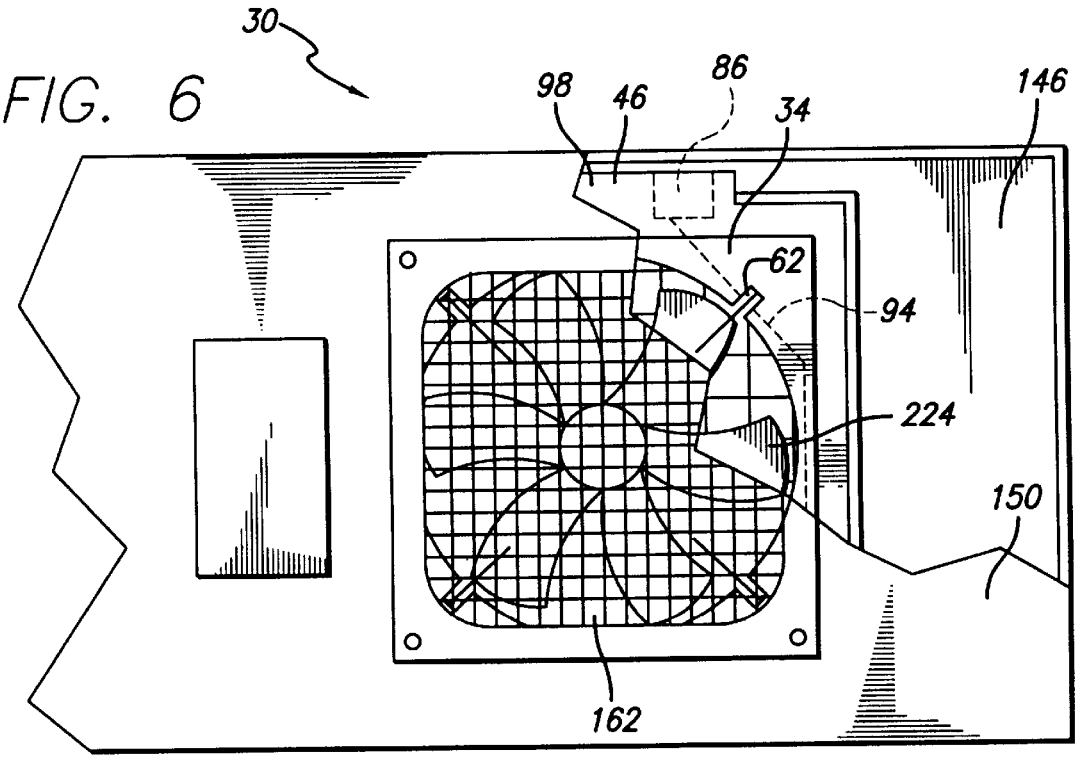

REPLACEABLE ELECTRICAL IONIZER MODULE

BACKGROUND OF THE INVENTION

The present invention is directed to systems and methods for cleaning and/or replacing emitter points of electrical ionizers.

Electrical ionizers are used to control static in clean production environments, such as in disk drive manufacturing facilities. The ionizers typically have pairs of emitter points to which charges are applied. The positive and negative emitter points are spaced apart in an air passageway through which air is passed by a fan. Examples of ionizers known in the prior art include those available from Charleswater of Canton, Mass., such as the "Neutralizer Plus," the "High Output Deluxe Overhead Ionizer," the "High Output Overhead Ionizer," the "Bench Top Ionizer—Ion Pump," and the "Neutralizer Jr. H/O" ionizers. The high voltage on the emitter points causes dust, dirt and various contaminants in the air to collect on the emitter points. However, the contamination build-up on the emitter points in ionizers used for electrostatic discharge control is detrimental to both performance and the balance of the ionizer output. Accordingly, a continuing maintenance program to keep the points or pins clean and the units operating efficiently is typically recommended by the ionizer manufacturers and employed by the users.

Various methods of cleaning emitter points are known in the prior art. One method requires that the ionizer unit be turned off and small brushes be inserted into slots in the unit and manipulated to brush-clean the emitter points. Some units have built-in sliding or rotating brushes which can be actuated by turning a built-in knob for example. These methods, which clean the emitter points while still in the ionizer units, often do not thoroughly clean the emitter points. Also, the dirt and debris removed from the emitter points during this cleaning process can be spread into the work environment thereby contaminating the sensitive (electronic) work products, such as computer disc drives.

Another prior art cleaning method requires that the ionizer unit be opened and the dirty emitter points (or pins) removed (using pliers typically), cleaned and reinstalled. This necessitates that work at the station of that ionizer is disrupted for a period of time during this cleaning process. Additionally, since the emitter points are very small, they are often lost or misplaced during this cleaning process.

SUMMARY OF THE INVENTION

Directed to remedying the problems in the prior art, disclosed herein is a module system for quickly, easily and consistently providing clean emitter points (or pins) without dirtying the working environment or work product. When the emitter points become dirty or contaminated, the module (or cassette) which includes the dirty emitter points secured to a support platter (or insulating substrate or carrier) is removed as a unit from the electrical ionizer housing. The module is then moved to a desired location, the points cleaned and the module reinserted into the housing. Alternatively, after the module is removed, a second similar module having clean emitter points is installed in the housing.

To install the module (either the original module with clean emitter points or the second similar module), the platter is inserted into an opening in the housing such that the side edges of the platter engage into opposing guide rails in the housing. The platter is slid along the rails until almost fully inserted at which time the levers, which are pivotally attached at the end of the platter, are pivoted out; the levers thereby bias against the housing, pushing the platter into an operative position in the housing. The levers define handle (s) for manipulating and handling the platter. In the operative position, the module's electrical connector, which is electrically connected to at least one of the emitter points and is secured to the support platter, operatively engages the corresponding electrical connector in the ionizer housing. Additionally, the air passage opening in the support platter into which the emitter points extend is thereby in an operative alignment with the fan in the electrical ionizer housing when the platter is in the operative position.

One embodiment is for the module's electrical connector to be configured as a male plug member at an end of the platter, which then plugs into the "female" card-edge connector in the housing when the platter is in the operative position. Another preferred embodiment includes the electrical connectors of the module to be adjacent to the side edges of the platter. The guide rails are attached to a pair of spaced circuit boards. Spring-biased electrical contacts are secured to the circuit boards, and are positioned so they engage the electrical connectors on the platter with the module in the operative position.

To remove the module (such as when its emitter points become dirty) from the ionizer housing, the levers are pulled out which pulls the platter a short distance out of the housing through the opening, and automatically disconnects the module's electrical connector(s) from the corresponding electrical connector(s) in the housing. Side edges of the platter are then grasped and the platter pulled and slid along the guide rails until the entire module is removed from the housing. The emitter points can then be removed and cleaned at a location remote from the work place. Alternatively, a second similar module with clean emitter points can then be installed.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 2 is a perspective view of the ionizer of FIG. 1 shown assembled (but without the top grate for illustrative purposes);

FIG. 3 is an enlarged perspective view taken on circle 3 of FIG. 1;

FIG. 4 is an enlarged cross-sectional view taken on line 4—4 of FIG. 2;

FIG. 5 is an enlarged cross-sectional view taken on line 5—5 of FIG. 2 (but without the fan for illustrative purposes);

FIG. 6 is a top plan view of the ionizer of FIG. 2 with a corner portion thereof broken away for illustrative purposes;

DETAILED DESCRIPTIONS OF PREFERRED EMBODIMENTS OF THE INVENTION

Figure 1:
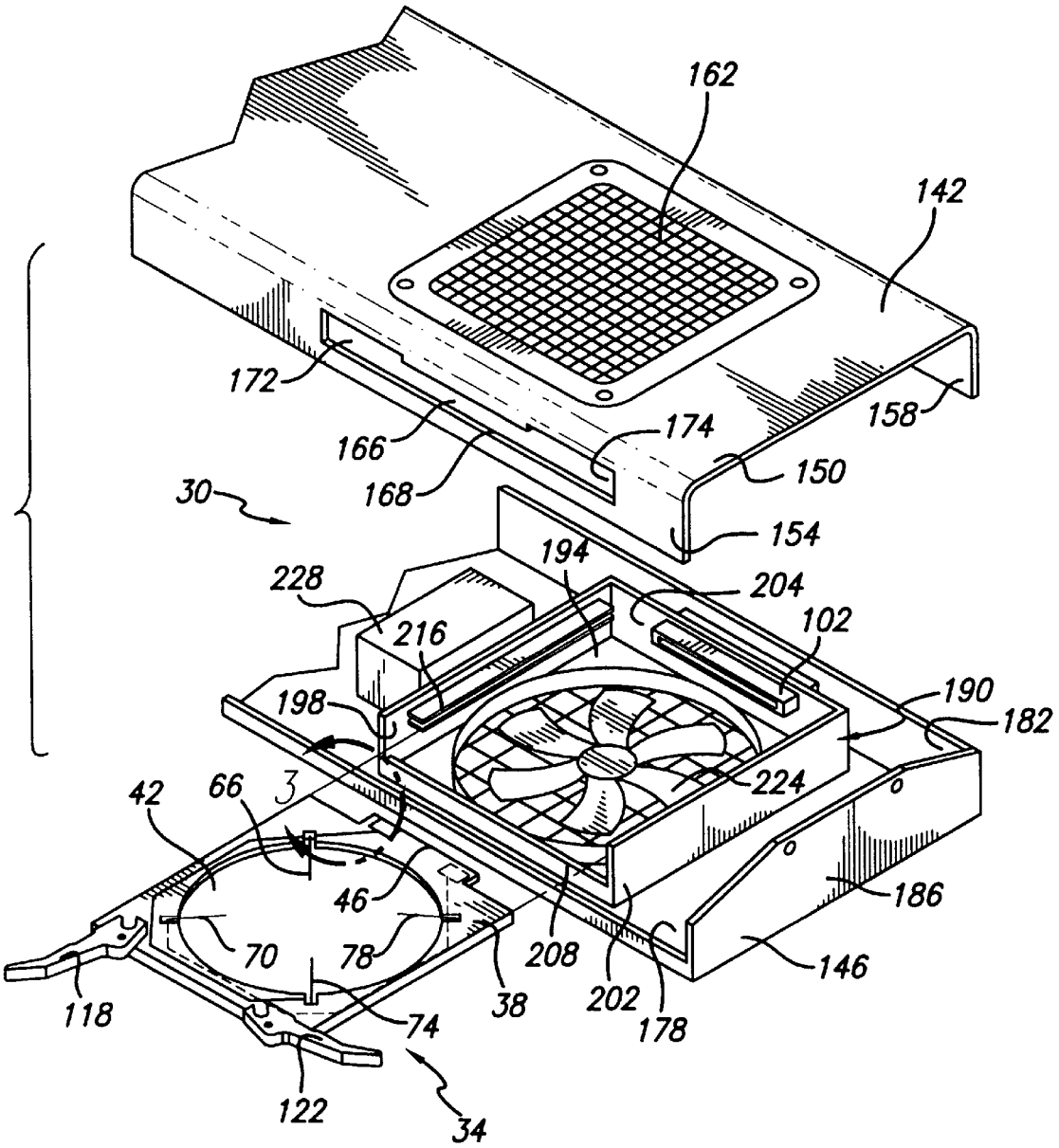
FIG. 1 is an exploded perspective view of a first electrical ionizer having a module of the present invention.
Figure 7:
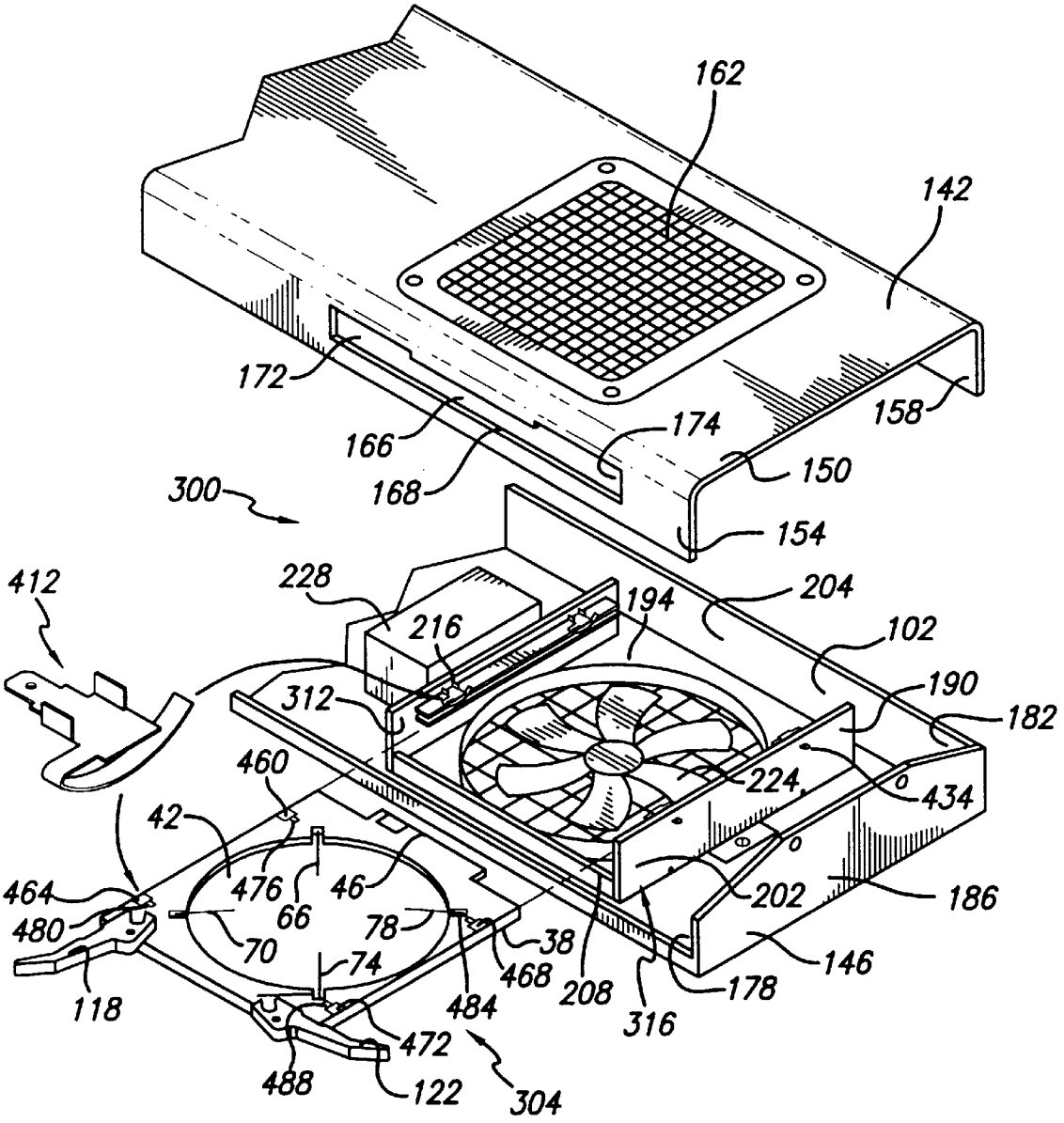
FIG. 7 is a view similar to FIG. 1 illustrating an alternative second electrical ionizer of the present invention.
Figure 8:
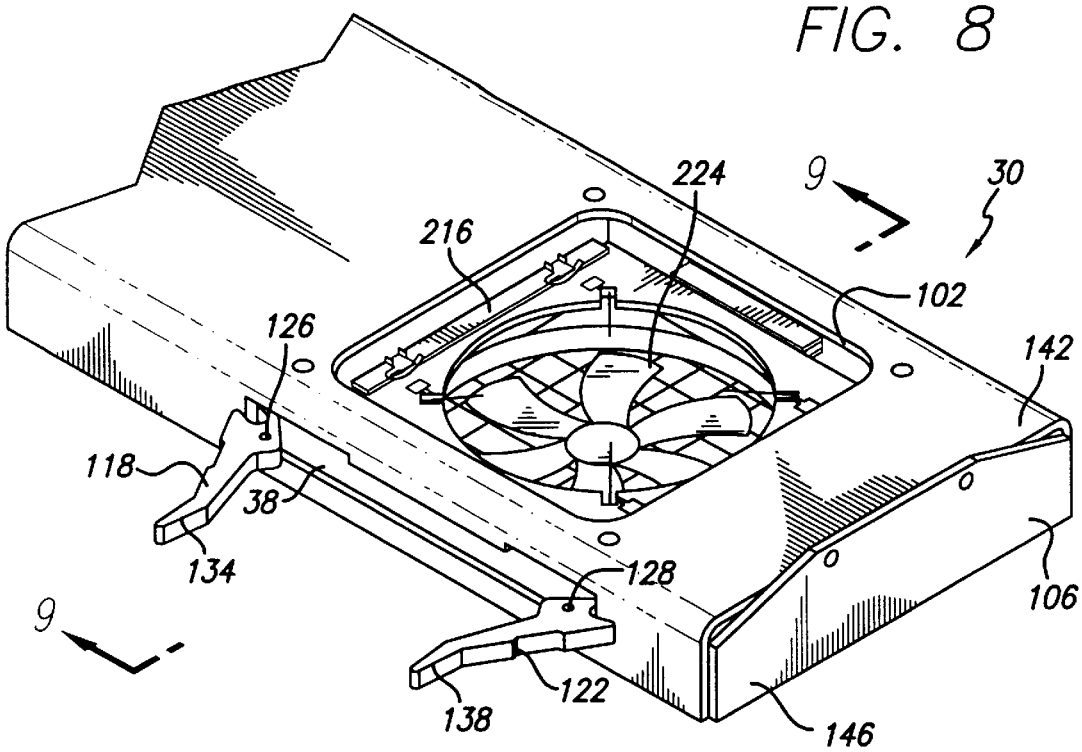
FIG. 8 is a view similar to FIG. 2 but of the alternative embodiment of FIG. 7.
Figure 9:
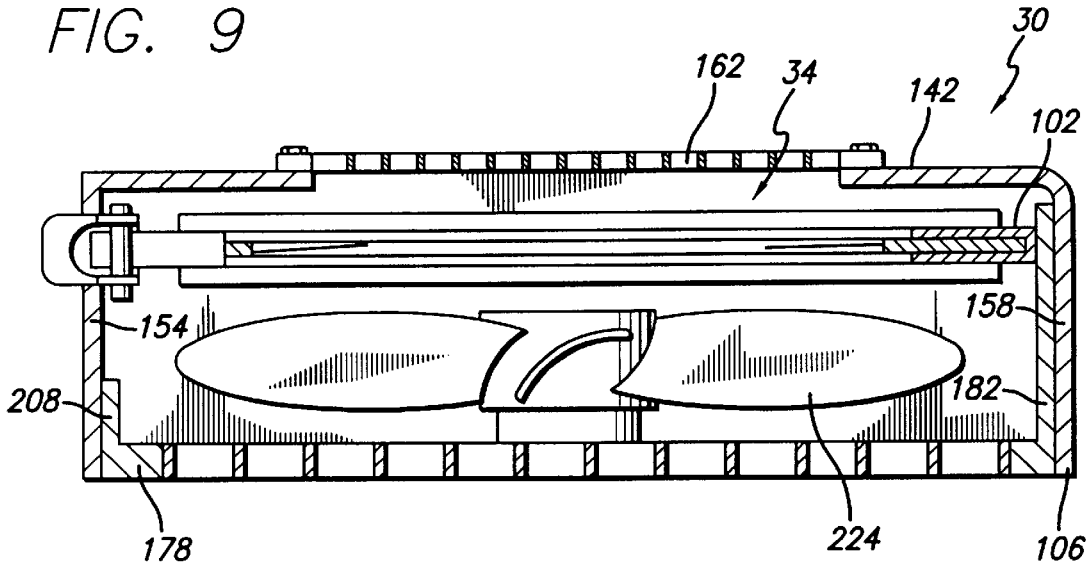
FIG. 9 is an enlarged cross-sectional view taken on line 9—9 of FIG. 8.

Referring to FIG. 1, an (a first) electrical ionizer adapted to and using an emitter point module of the present invention is shown generally at 30 and the module itself is shown generally at 34. The module 34 includes a platter 38 having a generally rectangular shape with a large opening or through-hole 42 in the center and a projection 46 at one end. Four sockets 50, 54, 58, 62 surround the central opening 42, facing towards the center of the opening. Emitter points or pins 66, 70, 74, 78 are releasably inserted into the sockets 50, 54, 58, 62, respectively, and when in place extend into the opening 42, as shown in FIG. 5.

A first electrical contact member 82 is formed on a first side of the projection 46 and at one end thereof. A second electrical contact member 86 is formed on an opposite second side of the projection 46 and at an opposite end thereof. First wiring 90 formed on a first side (the top or the bottom) of the platter 38 connects the first and third sockets 50, 58 (and thereby the first and third emitter points 66, 74) to the first electrical contact member 82. Second wiring 94 on an opposite second side (the bottom or the top) of the platter 38 connects the second and fourth sockets 54, 62 (and thereby the second and fourth emitter points 70, 78) to the second electrical contact member 86. The first and second electrical contact members 82, 86 thereby define the positive and negative contact members, respectively. It is also within the scope of the invention though for the module to have only one pair of emitter points or to have more than two pairs.

The first and second electrical contact members 82, 86 and the projection 46 form a male electrical member or plug shown generally at 98, which is adapted to plug into the female electrical member 102 in the housing 106 of the ionizer 30. The female electrical member 102 (or contact member or connector) can be a card-edge connector, for example. This type of male-female connection allows the electrical connection to be connected (and disconnected) by pushing (and pulling) the module 34 or more particularly the platter 38 to (and from) engagement of the plug 98 with the card-edge connector 102. However, it is also within the scope of the present invention to reverse the male-female connection so that the module 34 includes the female portion and the housing 106 includes the male portion. Although other types of connections aside from the card-edge connector 102 can be used as would be apparent to those skilled in the art, the plug 98 and card-edge connector 102 require no further connection step once the module 34 has been inserted. However, a less desirable arrangement (such as the flipping of a switch (not shown) once the module 34 is in place to make the electrical connection) is also within the scope of this invention.

One way of forming the module 34 is to provide a fiberglass resin sheet or flat panel which has a copper clad finish on both sides. The panel is cut to the desired shape and dimensions including the projection 46, and the center opening 42 is routed out. A photographic image of the tracks or wirings is provided, and the other material is etched away. This leaves the wiring 90, 94 and the male and female contact members 82, 86. The positive and negative contact members 82, 86 and the wirings 90, 94 can then be coated or plated with tin.

Four small notches or pockets are formed at the perimeter of the center circle 42 spaced from one another. The slots are preferably 0.072 inch wide and 0.271 inch deep. The centerlines of the slots cross at the center of the circular opening 42. The sockets 50, 54, 58, 62 having spring clips inside are soldered into respective notches. The emitter points or pins 66, 70, 74, 78 can then be clipped into position in the socket clips. Since the pins 66, 70, 74, 78 are made preferably of tungsten, palladium or titanium, they cannot be soldered directly to the platter 38 so the sockets 50, 54, 58, 62 are provided. Also, the spring-clip holding arrangement in the sockets 50, 54, 58, 62 allows the pins 66, 70, 74, 78 to be individually removed and replaced as needed.

Referring to FIG. 3, so that the projection 46 (or tail) easily plugs into the edgeboard or card-edge connector 102, it is desirable to bevel or break the corners 110, 114. And referring to FIG. 5, the platter 38 is square with length/width dimensions similar to that of the fan (as discussed later) and a thickness of 1/16 to 1/4 inch. The projection 46 has length and width dimensions suitable for the connector. The through-hole 42 has a diameter appropriate to the fan used.

Two levers 118, 122 are attached at respective pivot points 126, 128 at the end of the platter 38 opposite to the projection 46. They are attached adjacent opposite ends of the platter 38, and have mouths or claws 130, 132, respectively, at one end of the pivot point and elongated handles 134, 138, respectively, at the other ends of the pivot points, as shown in FIG. 5. They are shaped and function similar to similar levers used on many of today's printed circuit boards. Their purpose and operation are described in detail later in this disclosure.

As shown in the drawings, the housing 106 comprises a top piece 142 and a bottom piece 146, which are fitted and removably held together with screws, flexible snap-fits or the like. The top piece 142 includes a top wall 150, and front and rear panels 154, 158 angling down therefrom. A screen 162 is secured in or over the rectangular opening in the top wall 150. A housing opening 166 is provided in the front panel 154, as illustrated in FIG. 1. It is shaped like a slot 168 with two enlarged ends 172, 174 in a "dumbbell-type" shape, to accommodate the levers 118, 122, as will also be explained later.

The bottom piece 146 includes a floor 178, a rear wall 182 and opposite end walls 186 (only one of which is shown in the drawings). Mounted in the housing 106 on the floor 178 is a support assembly shown generally at 190. Support assembly 190 includes a floor 194, side walls 198, 202, a back wall 204 and a front lip 208. The floor 194 has a circular opening. The edge board connector 102 is secured in and to the back wall 204. First and second opposing pairs of rails 216, 220 are secured to the side walls 198, 202, respectively, disposed horizontally and aligned with the edgeboard connector 102. Other sliding/guiding structure arrangements, such as spaced posts or wall grooves, can be used instead of the rails.

A fan 224, such as the tubeaxial fan available from U.S. Toyo, is mounted in place in the support assembly 190. It is in alignment with the openings in the housing top wall, the support assembly opening and the floor opening, to define an air flow path through the housing 106. Referring to FIG. 4, preferably, the fan 224 is operated to blow the air downwardly. However, it is within the scope of the invention for the fan 224 to blow or push the air upwardly.

The circuitry for operating the fan 224 and for placing the charges on the emitter points 66, 70, 74, 78 through the card-edge connector 102 and then the wirings 90, 94 is shown generically at 228 in FIG. 1. This circuitry 228 would be connected by wires and plugs to a regular IEC inlet positioned on the housing 106 and through-openings in the housing. The circuitry 228 would be understood by those skilled in the art, and can be readily adapted from prior art ionizers including the Charleswater ionizers mentioned at the start of this disclosure.

With the housing pieces 142, 146 assembled and the grate(s) in place, the module 34 is inserted projection-end-first into the housing opening 166, as shown in FIG. 1. Since the opening 166 is aligned with the rails 216, 220, the side edges of the platter 38 automatically slide into the gap defined between the pairs of rails on both sides. Further pushing of the platter 38 moves the module 34 towards the position shown in FIG. 1. At this position, the handles 134, 138 of the two levers 118, 122 are grasped and pivoted away from the opening 166 and away from each other and further into the enlarged ends 172, 174 of the slot. As can be understood from FIG. 5, they thereby bias or push via mouths 130, 132 against the housing 106, or more particularly the front panel 154, and push the module 34 into the operative position in the housing. In the operative position the plug 98 is plugged into the edge connector 102 and the platter hole 42 is aligned with the air flow path produced by the fan 224 and through the various openings in the housing 106 and the grates.

After a period of use of the ionizer 30 with this module 34 and the dirtying of the emitter points 66, 70, 74, 78, the module 34 is removed so that the emitter points can be cleaned or so that other clean emitter points can be substituted. To remove the module 34, which is in the position shown in FIG. 5, the ends of the handles 134, 138 are grasped and pulled outwardly, that is, in opposite directions away from each other. This causes the claws or mouths 126, 130 to push against the housing and pull the platter 38 a distance out from the housing 106. The levers 118, 122 can then be used as handles to pull the platter 38 the remaining distance out of the housing 106 or the platter can be directly grasped by the user and pulled out. The pulling causes the platter 38 to slide along the guide rails 216, 220 (or in the slots defined between them) and to thereby be guided out the housing opening 166.

Once the module 34 is out of the housing 106, the emitter points 66, 70, 74, 78 can be cleaned while still in the sockets 50, 54, 58, 62 on the platter 38 or they can be removed from the spring clips in the sockets and cleaned. They can be cleaned with a small brush, with a swab moistened with alcohol or placed in an ultrasonic cleaner. If the points 66, 70, 74, 78 were removed to be cleaned, they are reinstalled after cleaning. The module 34 with the cleaned points is then reinstalled with the easy, quick and reliable procedure outlined above. Instead of cleaning and reinstalling the module 34 with the cleaned points, a fresh set of points can be installed in the module.

Another alternative is to provide a second module with clean points and after removing the (first) module 34 with the dirty points, installing the second module. This procedure results in only minutes of downtime for the ionizer 30. In some places, many hundreds of ionizers 30 may be in use. So one maintenance program pursuant to this invention replaces all of the modules in the use with modules having clean emitter points in a single procedure and with little disruption to the workplace. Additionally, since the pins or points 66, 70, 74, 78 are cleaned at a location remote from the work site, no dirt or dust from the points is transmitted to the work site.

Referring to FIGS. 7–16, an alternative electrical ionizer of the present invention is shown generally at 300 and the cartridge or module therefor is shown generally at 304. Ionizer 300 is similar in many respects to ionizer 30, and thus many corresponding components have the same reference numerals in the drawing figures. There are two major differences, as will be explained in greater detail later. One is that the (aluminum) housing has been replaced by two circuit boards (or side walls) mounted on opposite sides of the fan. The other is that the plug connector has been replaced by four contact springs.

Figure 15:
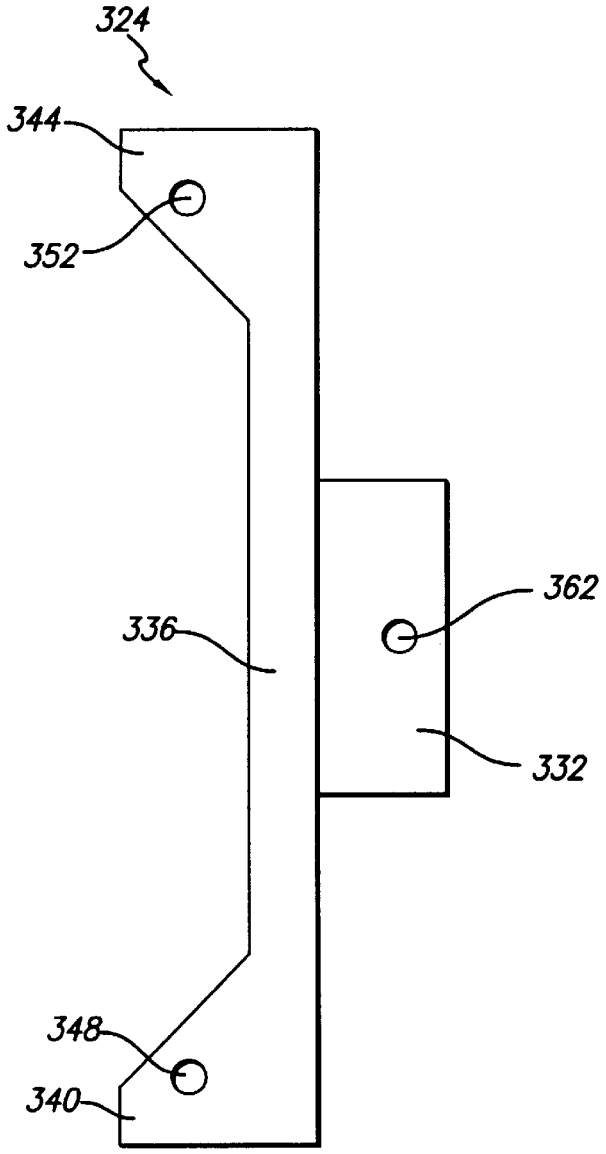
FIG. 15 is an enlarged top plan view of one of the mounting brackets of the embodiment of FIG. 7 illustrated in isolation.
Figure 16:
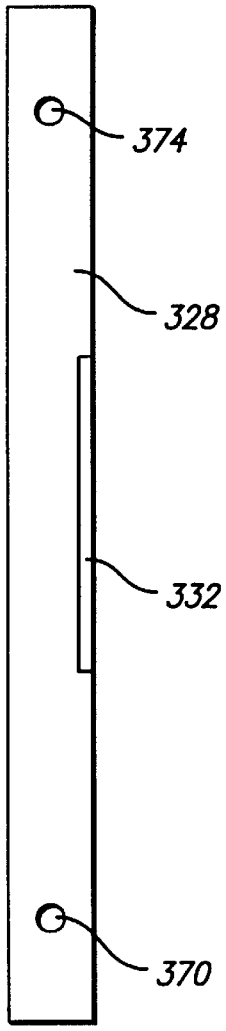
FIG. 16 is a side elevational view thereof.
Figure 17:
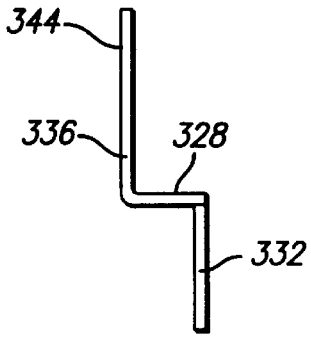
FIG. 17 is an end view thereof.

The two side circuit boards are designated by reference numerals 312, 316. Aluminum board brackets 320, 324 secure the circuit boards 312, 316, respectively, in place on opposite sides of the housing 328 of the fan 224. The brackets 320, 324 are shown, for example, in FIG. 12. And one of them (324) is shown in isolation and in various views in FIGS. 15–17, the other (320) being a mirror image thereof. The brackets 320, 324 both have a long short wall 328, a small central lower flange 332, and a top flange 336 having fore and aft end wings 340, 344. As shown in FIG. 15, the wings 340, 344 have holes 348, 352 through which screws or rivets 356 pass to secure the brackets 340, 344 to the fan housing. Similarly, the lower flange 332 has a hole 362 through which a rivet or screw 366 passes to secure the bracket to the floor. The circuit boards 312 and 316 can have narrow slots or indents at the centers of their bottom edges for receiving the lower flanges 332 therethrough. Likewise, holes 370, 374 in the wall 328, as shown in FIG. 16, are formed for rivets or screws 380 for securing the bracket(s) 320 (and 324) to the circuit board(s) 312 (and 316).

The guide strips 390, 394 receive therein side edges of the platter 38 and guide the platter (or module) to and from a position outside of the housing and an operative position in the housing and relative to the fan 224. These guide strips 390, 394 have flexible, compressible snaps 400, 404, which are snapped in through holes in the circuit boards 312, 316 and thereby secure the guide strips in horizontal disposition to the respective circuit boards, as illustrated in FIG. 12, for example.

Figure 10:
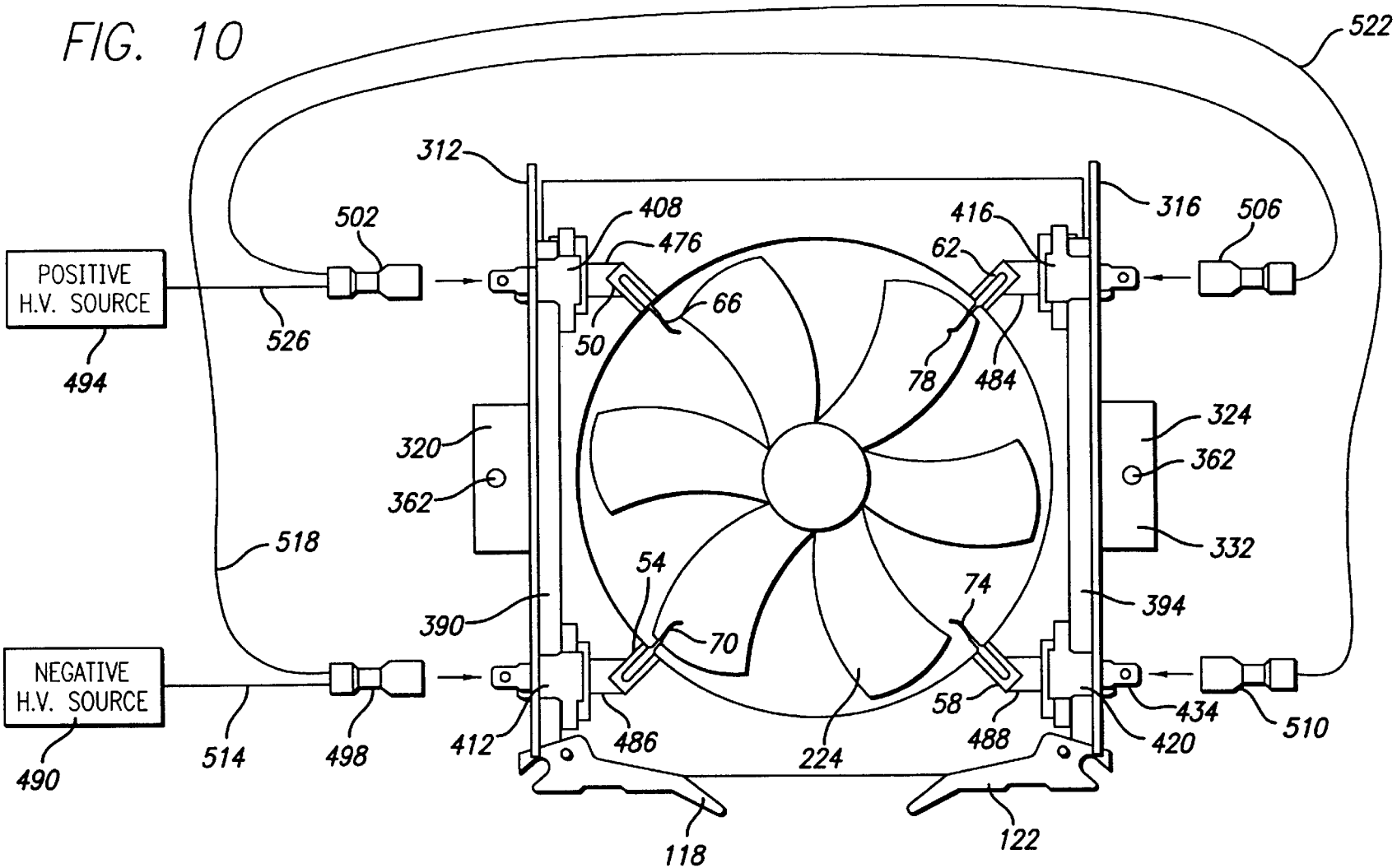
FIG. 10 is a top plan view of the embodiment of FIG. 7 without the top cover and the bottom tray and showing the electrical connections.
Figure 13:
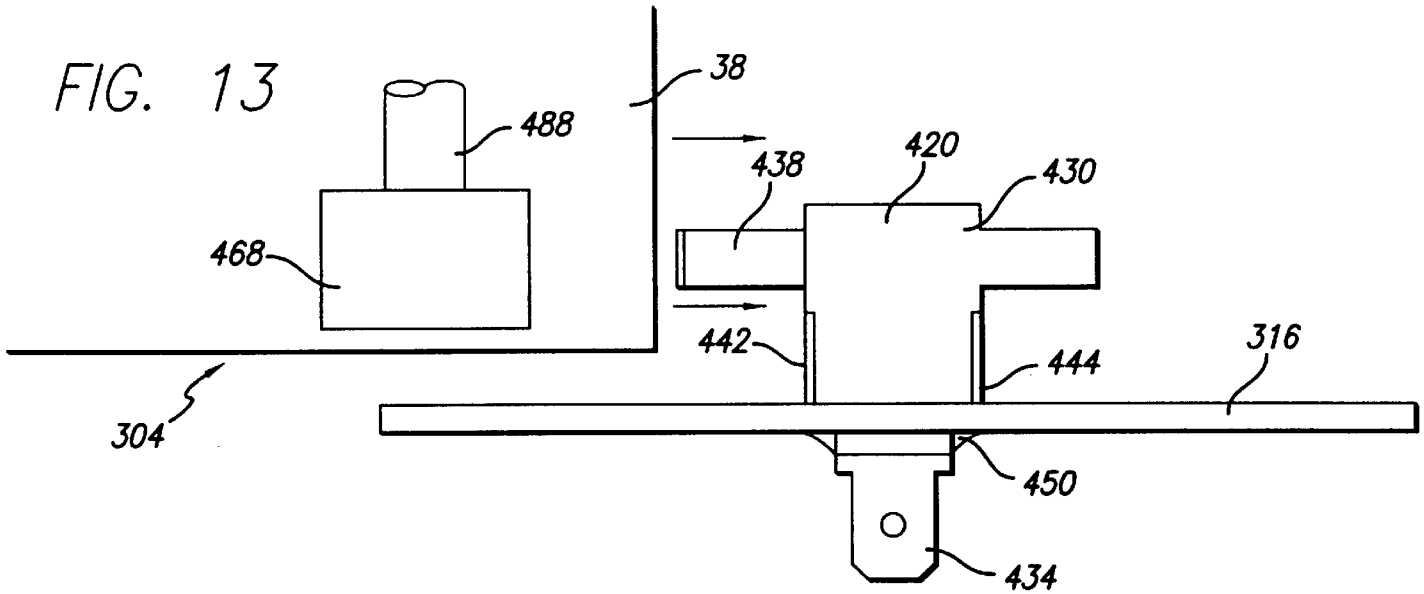
FIG. 13 is a simplified enlarged top view of the lower right corner of FIG. 10 showing the module sliding into operative contact with the bias contact spring.
Figure 14:
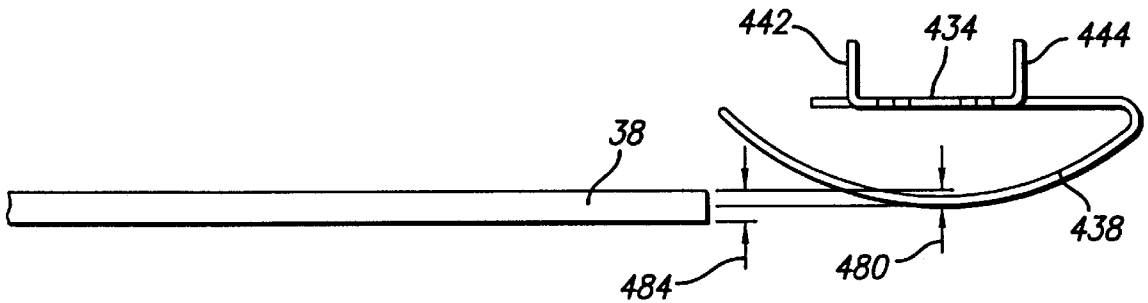
FIG. 14 is a side elevational view of FIG. 13.

Referring to FIGS. 10, 13 and 14, for example, two (beryllium-copper) contact springs 408, 412 are secured in spaced relation to the circuit board 312 and two contact springs 416, 420 are secured in spaced relation to circuit board 316. Each of the contact springs 408, 412, 416, 420 has a body portion 430, an outwardly-extending tab 434 at an (outward) end, a downwardly-extending spring arm 438 at an opposite (inward) end, and a pair of upright flanges 442, 444 at a central location. The tab 434 is passed a slot in the circuit board 312 or 316. With the flanges 442, 444 then abutting the inward face of the circuit board, the spring clip is soldered to the outward face with solder 450, as shown in FIG. 13. The flanges 442, 444 thereby provide support to their respective contact springs and also assist in aligning the contact springs during the soldering process. The contact springs on each circuit board are electrically isolated from one another; that is, no traces connect them.

The platter 38 has four contact pads 460, 464, 468, 472 on a top surface thereof. Each of the pads is adjacent to a respective emitter point socket and electrically connected thereto by connectors 476, 480, 484, 488, respectively. Two of the pads 460, 464 are spaced along one edge of the platter and the other two pads 468, 472 are spaced along the other edge. The contact pads 460, 464, 468, 472 and the connectors 476, 480, 484, 488 to the emitter sockets can be plated with tin or other material to reduce the likelihood of corrosion forming.

Figure 11:
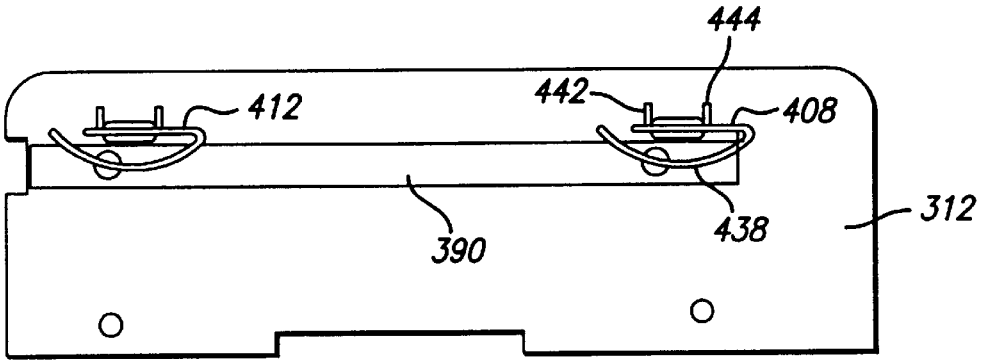
FIG. 11 is a simplified side view taken on FIG. 10.
Figure 12:
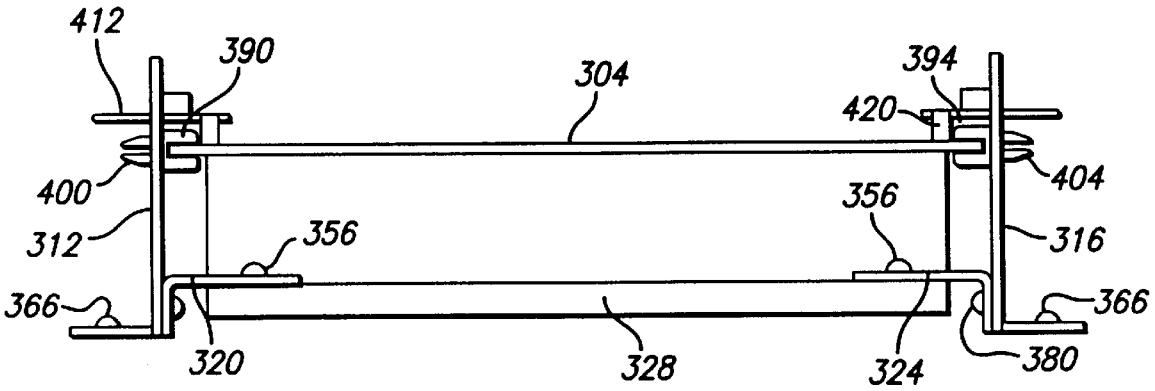
FIG. 12 is a simplified front view taken on FIG. 10.

The spring arms 438 of each of the contact springs 408, 412, 416, 420 are positioned adjacent the guide rails as can be seen in FIGS. 11 and 12, for example. When the module 304 is slid along the guide rails 390, 394 into an operative position, each of the contact springs 408, 412, 416, 420 is biased against and in operative electrical contact with a respective contact pad 460, 464, 468, 472, as shown in FIG. 10. The contact springs make good consistent electrical contact with their respective pads due to the spring bias of the contact springs or more particularly the spring arms 438. This can best be understood from FIG. 14, which shows that in its natural state the spring arm 438 extends a distance designated by reference numeral 480 below the plane of the top surface of the incoming platter 38. The distance 480 is preferably 0.0313 inch or about half of the thickness 484 of the platter 38. Thus, as the module 304 is slid on the guide rails 390, 394 by the user to its operative position the leading edge of the platter 38 engages the spring arms 438 and pushes them up distance 480. The natural bias of the spring arms 438 then holds them firmly against the respective contact pads when the module 304 is in position.

Negative and positive high voltage sources 490, 494, respectively, are shown in FIG. 10, as are slide connectors 498, 502, 506, 510. Two wires 514, 518 are crimped to an end of a slide connector 498 and the other end is slid onto the tab of spring connector 412. Wire 514 is connected at its other end to the negative higher voltage source 490. The other end of wire 518 is crimped into the end of slide connector 506. Slide connector 506 is slid onto the tab of contact spring 416. Wire 522 has one end crimped into an end of slide connector 502 and its other end crimped into slide connector 510. Wire 526 then connects the positive high voltage source 494 to the slide connector 502. With the module 304 slid into the operative position, this wiring arrangement connects the negative high voltage source 490 with the negative emitter points 70 and 78 and the positive high voltage source with the positive emitter points 66 and 74.

The module 304 is moved to and from its operative position using levers 118, 122 as described with respect to ionizer 30. When in the fully inserted operative position the contact pads 460, 464, 468, 472 line up and make electrical contact with their respective contact springs 408, 412, 420, 416. The contact springs allow the module 304 to be easily removed from the housing so that the dirty emitter points can be cleaned or replaced, as described above with respect to module 34.

Referring now to FIGS. 18–22, an alternative preferred electrical ionizer of the present invention is shown generally at 550. The housing enclosure is similar to or the same as that of the previously-discussed embodiments. Ionizer 550 is similar in many respects to ionizers 30 and 300, and thus many corresponding components have the same reference numerals in the drawing figures.

Figure 18:
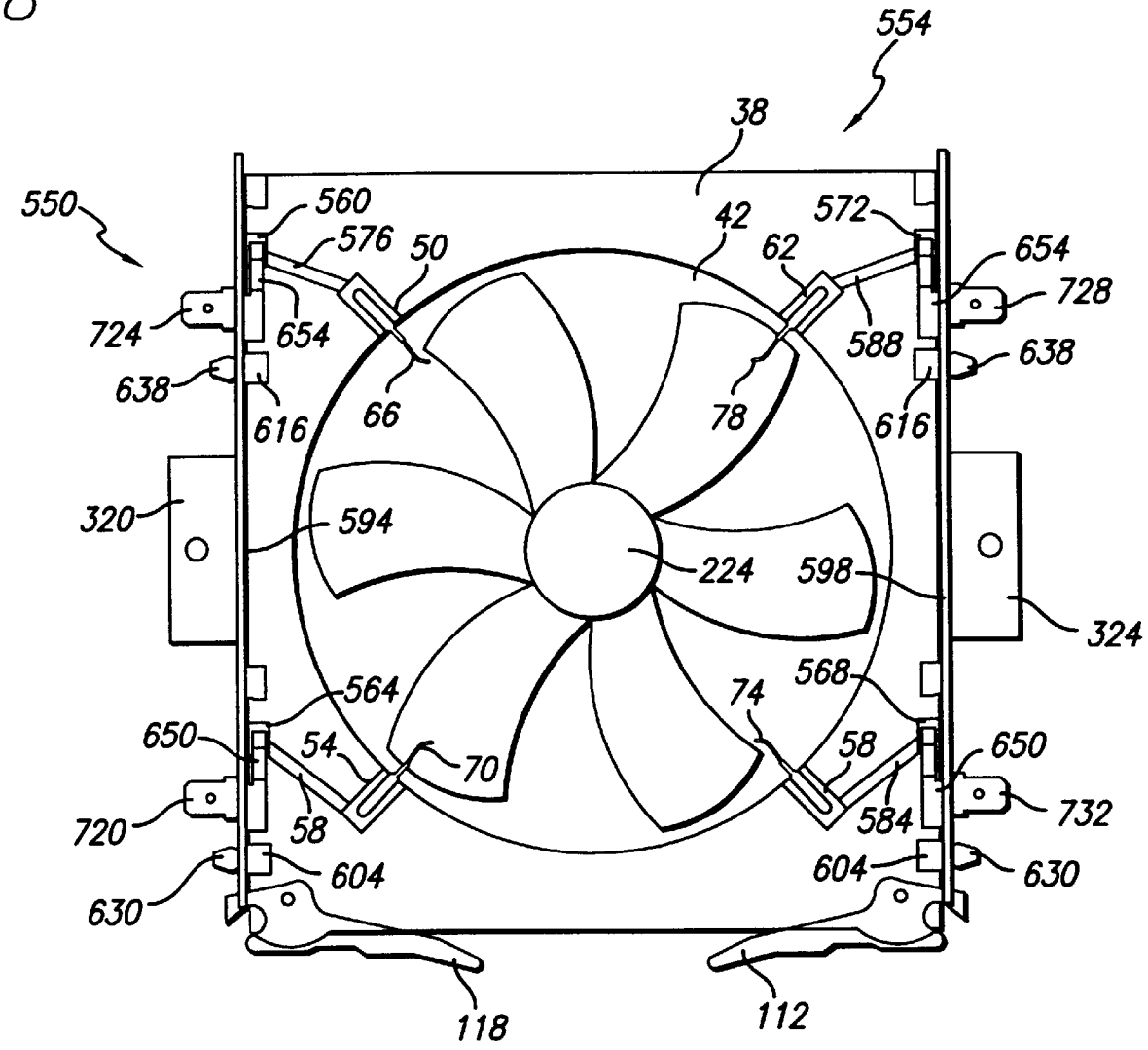
FIG. 18 is a top plan view similar to FIG. 10 (but with the wiring connections omitted for illustrative purposes) of another alternative (preferred) embodiment of the present invention.

The module 554 of ionizer 550 is similar to the module 304. It has pins or points 66, 70, 74, 78, mounted in sockets 50, 54, 58, 62 on the perimeter of the central opening 42 of the platter 38 and extending into the opening in the flow path of the fan 224. The contact pads 560, 564, 568, 572 on the top surface of the platter 38 are connected to the respective sockets 50, 54, 58, 62 by wirings 576, 580, 584, 588 on the top of the platter. The wirings are formed in a process which includes chemically etching laminated copper clad to produce the traces or wirings. The contact pads of the embodiment of FIG. 18 are positioned in different locations than those of the embodiment of FIG. 10, and thus the routes of the wirings are different. These repositioning and changes are due to the lengths of the retainer springs as discussed later.

The circuit boards or sidewalls 594, 598 are mirror images of each other. Their constructions are different though than those of circuit boards 312, 316. However, they are attached to the housing (106) and the fan housing 328 using brackets 320, 324, rivets 366, 356, etc.

The elongate guide rail or guide strips 390, 394 are not used on sidewalls 594, 598. Instead a combination of structures are used to provide the guiding and sliding functions for the module 554 into and out of the housing 106 through the dumbbell shaped opening or slot 168. This combination includes for each of the sidewalls 594, 598, or slot 168, a front pair of spaced fixed posts 604, 608, which define a guide slot 612 therebetween, and a rear pair of spaced fixed posts 616, 620, which similarly define a guide slot 624 (FIG. 20) therebetween. Each of the guide posts is attached through holes in the circuit boards using compressible snaps 630, 634, 638.

The retainer/spring assemblies provide not only a guiding and sliding function, but also an electrical connection function. Each of the circuit boards 594, 598 includes a front retainer/spring assembly 650 and a rear retainer/spring assembly 654. The assemblies 650, 654 have identical constructions and differ only in their position on the circuit boards 594, 598.

Figure 21:
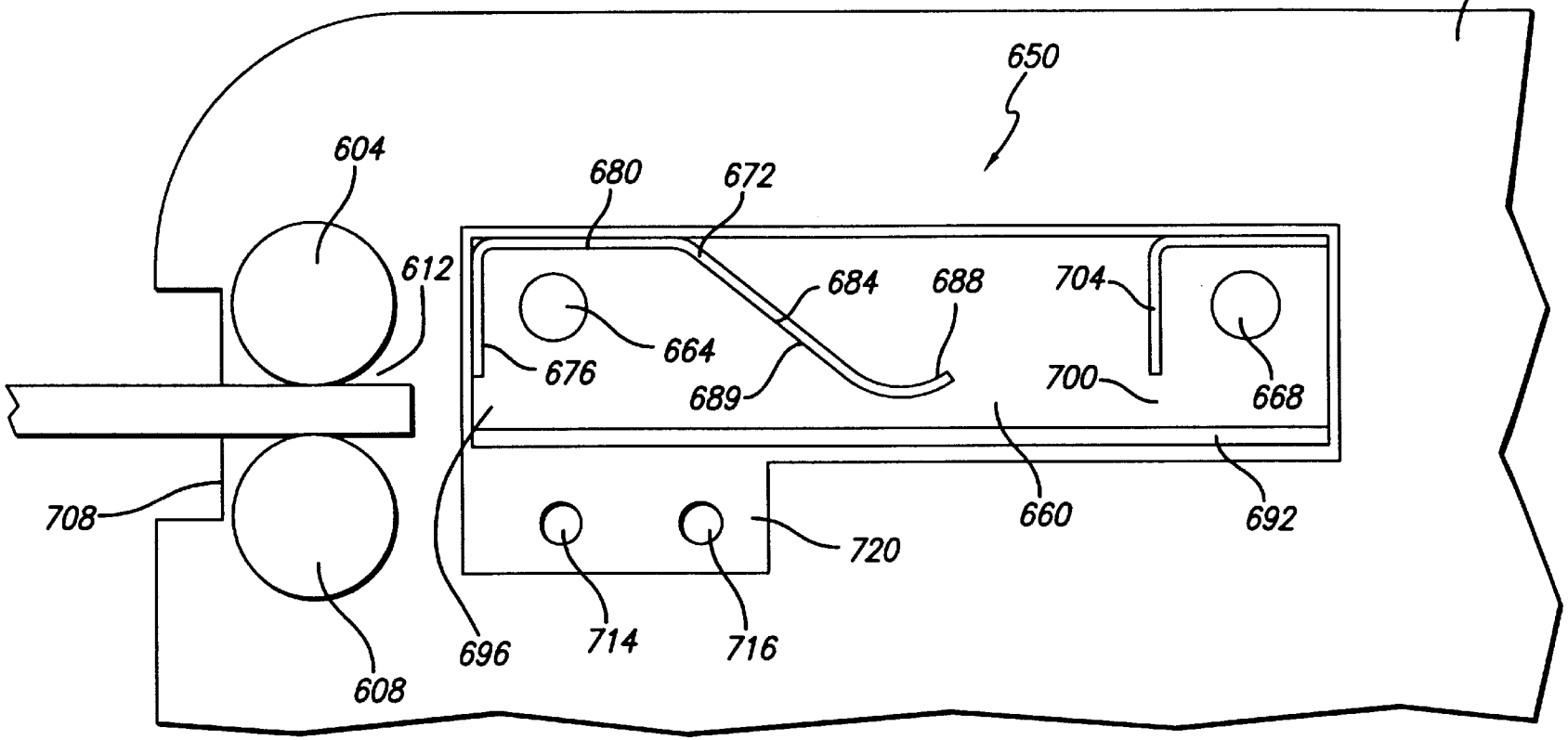
FIG. 21 is an enlarged view of the upper left portion of FIG. 20 showing a module of the present invention being inserted therein.
Figure 22:
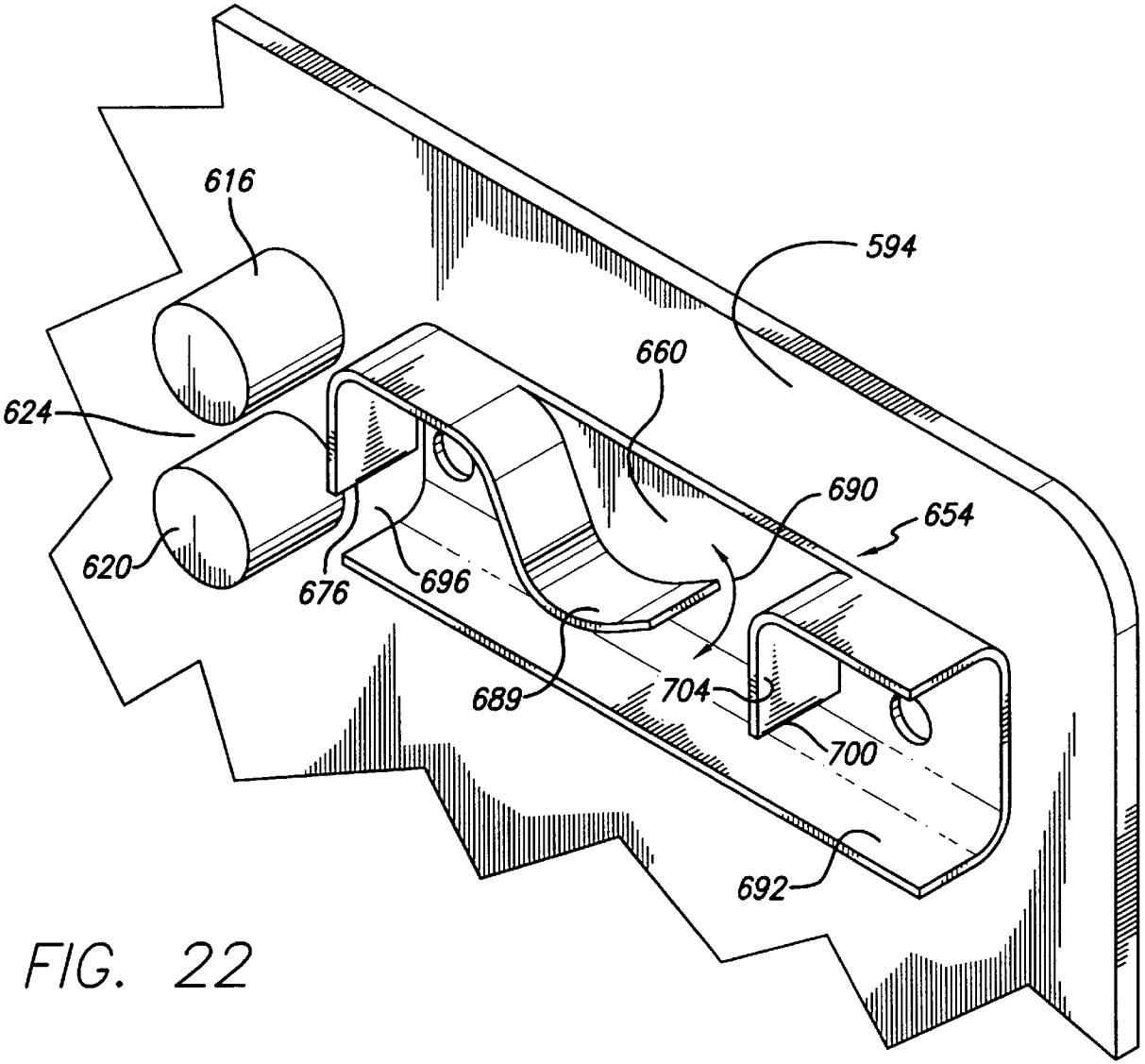
FIG. 22 is a perspective view of the upper right portion of FIG. 20.

The front retainer/spring assembly 650 is shown in enlarged detail in FIG. 21 and the rear retainer/spring assembly 654 in FIG. 22. Referring thereto, they are seen to include a circuit plate or pad 660 which is secured to the circuit board with rivets 664, 668. Secured to the plate 660 and extending out therefrom is a contact spring arm 672, which includes a vertical portion 676, an upper horizontal portion 680, a downwardly angled portion 684 and an upwardly curving end 688. While the vertical portion 676 and the upper horizontal portion are both directly secured along their outboard edges to the plate 660, the downwardly angled portion 684 and the upwardly curving end 688 are not. Rather, portions 684 and 688 define a spring-biased arm 689, movable as shown by arrow 690 in FIG. 22; that is, arm 689 is cantilevered out from horizontal portion 680.

A horizontal (guide rail) piece 692 is also secured to the plate 660 and is spaced below the lower tip of the vertical portion 676 to define an opening 696. A slot or opening 700 is also formed at a rear portion of the assembly 650 between the horizontal piece 692 and the lower tip of the angled member 704.

Thus, when the module 554 is inserted in through the front opening 166 in the housing front panel 154 at the respective notch cuts 708 in the circuit boards 594, 598, side edges of the platter 38 are guided by the front posts 604, 608 in through guide slot 612, in through slot 696, along horizontal piece 692, and through slot 700. As the module 554 is pushed further into the housing, it passes through guide slot 624 and then through the opening 696 and along the guide rail 692, past the spring-biased arm 689, and through the opening 700. The levers 118, 122 on the module act as a stop, when they come to a rest on the narrowed portion of the opening on the front panel, after they have hooked on the cover or front panel and been pushed forward.

When the forward edge of the platter 38 engages the spring-biased arms 689, it biases the curving ends 688 up and passes under them. Then when the module 554 is in a fully inserted position, each of the spring arms 689 is naturally biased down into firm electrical contact with a corresponding contact pad 560, 564, 568, 572 of the module.

Figure 19:
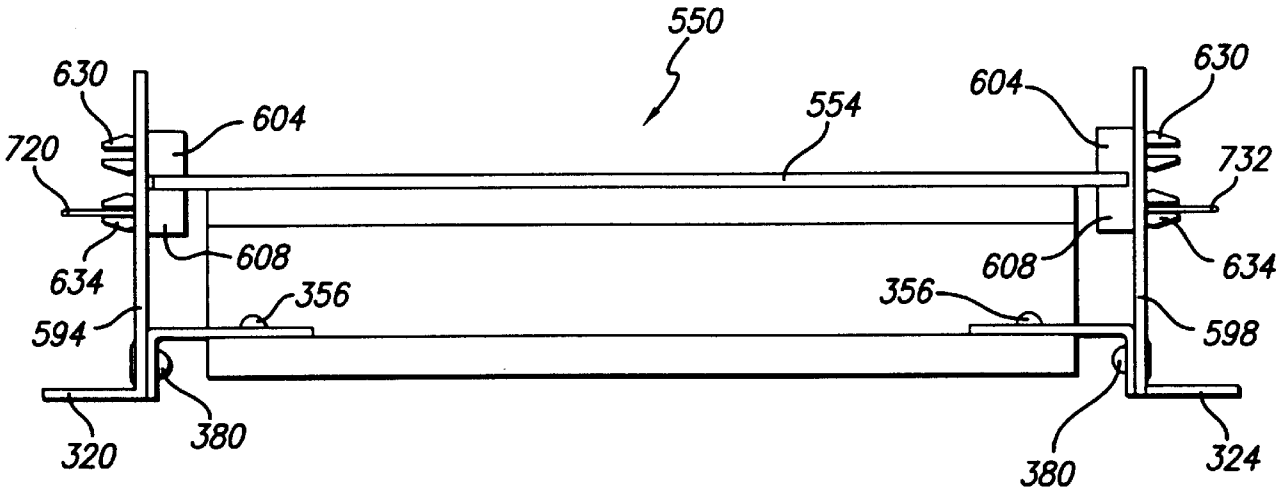
FIG. 19 is a simplified front view of the embodiment of FIG. 18.
Figure 20:
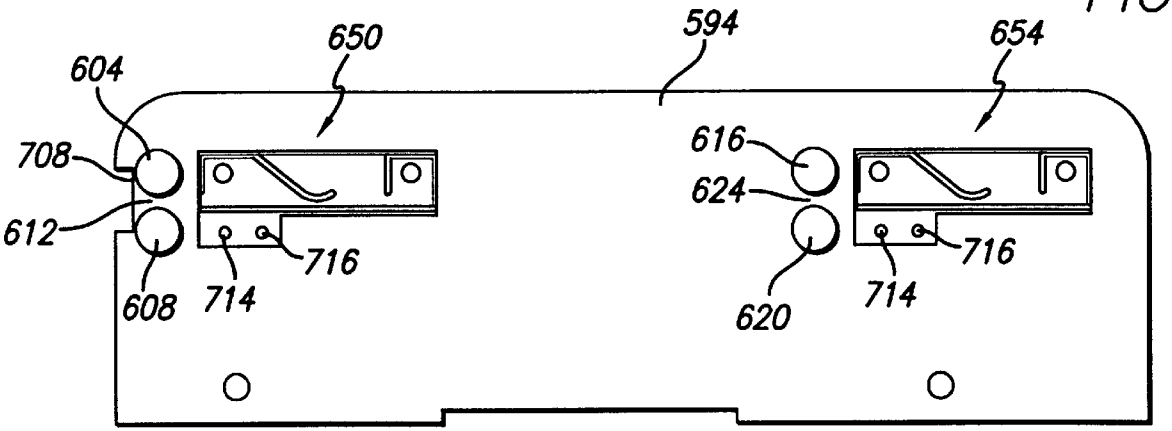
FIG. 20 is a simplified interior side elevational view of one of the side circuit boards of the embodiment of FIG. 18.

FIGS. 21 and 22 show the holes 714, 716 in the tabs 720 of the contact plate. The tabs 720, 724, 728, 732, as depicted in FIGS. 18 and 19, are mounted in and soldered to the holes 714, 716. The slide connectors 498, 502, 506, 510 are crimped onto the tabs 720, 724, 728, 732, respectively, with the wirings as shown in the FIG. 10. The contact plate 660 then provides the electrical connection between the respective spring arms 689 and the tabs 720, 724, 728, 732.

From the foregoing detailed description, it will be evident that there are a number of changes, adaptations and modifications of the present invention which come within the province of those skilled in the art. For example, this invention includes using the concepts described above and adapting the electronics for a personal ionizer, which is a small single fan unit that sits on top of a table. However, it is intended that all such variations not departing from the spirit of the invention be considered as within the scope thereof.

What is claimed is:

1. An electrical ionizer module, comprising:

a support platter having an air passage opening therethrough;

at least two emitter points supported by the support platter so as to extend into the opening; and an electrical connector supported by the support platter and in electrical communication with at least one of the emitter points, the electrical connector being adapted to operatively engage with a corresponding electrical connector of an electrical ionizer when the support platter is moved into an operative position in a housing of the electrical ionizer with the air passage opening moved into position relative to a fan of the electrical ionizer.

2. The module of claim 1 wherein (1) the at least two emitter points comprise first, second, third and fourth emitter points, (2) the electrical connector defines a first electrical connector member on a top surface of the support platter, positioned between the first emitter point and a side edge of the support platter, and electrically connected to the first emitter point, and (3) the module further comprises (a) a second electrical connector member on a top surface of the support platter, positioned between the second emitter point and a side edge of the platter, and electrically connected to the second emitter point, (b) a third electrical connector member on a top surface of the platter, positioned between the third emitter point and a side edge of the platter and electrically connected to the third emitter point, and (c) a fourth electrical connector member on a top surface of the platter, positioned between the fourth emitter point and a side edge of the platter and electrically connected to the fourth emitter point.

3. The module of claim 1 further comprising a projection member at a back end of the support platter, and the electrical connector being secured to the projection member, and wherein the electrical connector member includes a positive electrical contact member at one end of the projection member, and further comprising a negative contact member at another end of the projection member.

4. The module of claim 1 wherein the at least two emitter points include first and second emitter points, and the electrical connector includes a positive connector electrically connected to the first emitter point by first wiring on the support platter, and further comprising a negative electrical connector electrically connected to the second emitter point by second wiring on the support platter.

5. The module of claim 4 further comprising a projection at a rear end of the support platter, the positive and negative connectors being secured to the projection at opposite ends thereof.

6. The module of claim 5 wherein the projection is formed as a continuous piece of material with the support platter, and the positive and negative connectors are secured to opposite faces of the projection, and the projection and the positive and negative connectors thereby define a plug unit.

7. The module of claim 4 wherein the first wiring and the positive connector are on one side of the platter, and the second wiring and the negative connector are on an opposite side of the platter.

8. The module of claim 1 wherein the at least two emitter points further include third and fourth emitter points, the third emitter point being electrically connected by wiring on the platter to the first emitter point and the fourth emitter point being electrically connected by wiring on the platter to the second emitter point.

9. The module of claim 1 further comprising at least one handle connected to the support platter and adapted to assist in moving the support platter to and from the operative position relative to the housing.

10. The module of claim 9 wherein the at least one handle includes first and second levers both pivotally attached to the support platter such that (1) with the support platter in the operative position both of the levers can be manually pulled out, biasing against the housing, and thereby disconnecting the electrical connector from the corresponding electrical connector so that the support platter can be removed from the housing and (2) with the support platter adjacent to but spaced from the operative position, both of the levers can be manually pushed in, biasing against the housing, and moving the support platter into the operative position.

11. The module of claim 9 wherein the levers are pulled out in opposite pivotal directions, and the levers are pushed in opposite pivotal directions.

12. The module of claim 1 wherein the air passage opening comprises a large hole in a center of the platter.

13. The module of claim 1 further comprising sockets secured to the platter and which releasably hold respective ones of the emitter points in position relative to the opening.

14. An electrical ionizer, comprising:

a housing having a housing opening;

a fan disposed in the housing;

a first electrical connector disposed in the housing; and a module including (1) a support platter having an air passage opening therethrough, (2) at least two emitter points supported by the support platter so as to extend into the air passage opening, and (3) a second electrical connector supported by the support platter and in electrical communication with at least one of the emitter points;

the module being insertable through the housing opening and into an operative position in the housing wherein the first electrical connector is operatively connected to the second electrical connector and the air passage opening is in operative relationship with the fan.

15. The ionizer of claim 14 further comprising a support wall in the housing, wherein the first electrical connector includes a connector plate mounted on an inside surface of the support wall, a spring contactor arm mounted to the connector plate and a connector tab secured to the connector plate from an outside surface of the support wall through an opening in the wall and the plate.

16. The ionizer of claim 15 further comprising module guide structure mounted on the plate.

17. The ionizer of claim 14 wherein the first electrical connector is spring-biased.

18. The ionizer of claim 14 further comprising first and second opposing walls, and guide structures supported by the walls to guide the module when inserted through the housing opening to the operative position.

19. The ionizer of claim 18 wherein the module is removable from the operative position out through the housing opening in a sliding motion along the guide structures.

20. The ionizer of claim 18 wherein the guide structures include a first pair of guide rails snap fit secured to the first wall and a second pair of guide rails snap fit secured to the second wall.

21. The ionizer of claim 18 further comprising a bracket which secures the first wall upright in the housing and to a housing of the fan.

22. The ionizer of claim 14 further comprising guide structure supported in the housing and which guides the module when manually inserted through the housing opening to the operative position.

23. The ionizer of claim 22 wherein the guide structure includes two pairs of opposing guide rails into and along which side edges of the platter slide to and from the operative position.

24. The ionizer of claim 23 wherein the housing opening defines an elongate slot, and the guide rails are aligned with the slot.

25. The ionizer of claim 24 wherein the module includes first and second handles attached to the support platter, and the elongate slot has enlarged openings at opposite ends thereof configured to receive therein the first and second handles.

26. The ionizer of claim 22 wherein the guide structure includes guide members attached to the housing, extending generally horizontally out therefrom and forming a horizontal gap therebetween, the gap defining a module guide slot.

27. The ionizer of claim 26 wherein the guide members comprise pairs of horizontal posts.

28. The ionizer of claim 14 wherein the housing opening comprises an elongate slot through which the module passes when moved in a sliding motion to and from the operative position.

29. The ionizer of claim 28 wherein the module includes first and second levers attached to the support platter, and the elongate slot has enlarged openings at opposite ends thereof configured to receive the first and second levers.

30. The ionizer of claim 14 wherein the module includes a projection attached to the support platter, and the electrical contact member is secured to the projection, and wherein the second electrical connector defines a positive electrical connector, the module includes a negative electrical connector in electrical communication with at least one other of the emitter points, and the negative electrical connector is secured to the projection at a location spaced from the positive electrical connector.

31. The ionizer of claim 14 wherein the module includes at least one handle connected to the support platter to assist in manually moving the module to and from the operative position.

32. The ionizer of claim 31 wherein the at least one handle comprises first and second levers, both pivotally attached to the support platter such that (1) with the module in the operative position both of the levers can be manually pulled out, biasing against the housing, and thereby pulling the second electrical connector from the first electrical connector and pulling the module out through the housing opening and (2) with the module inserted in through the housing opening, both of the levers can be manually pushed in, biasing against the housing, and thereby pushing the second electrical connector into operative engagement with the first electrical connector and the module into the operative position.

33. The ionizer of claim 32 wherein the housing opening includes an elongate slot having enlarged ends, and the first and second levers are disposed in the enlarged ends when the module is in the operative position.

34. The ionizer of claim 14 wherein the first electrical connector defines at least in part a female member, and the second electrical connector defines at least in part a male member which plugs into the female member when the module is inserted into the operative position.

35. An electrical ionizer, comprising:

a housing having a housing opening;

a fan disposed in the housing;

a module including (1) a support platter having an air passage opening therethrough and (2) at least two emitter points supported by the support platter so as to be operatively positioned relative to the opening; and slide-guide structure supported in the housing and which guides the module when manually inserted through the housing opening and slid into an operative position in the housing with the air passage opening in operative relationship with the fan, and which also guides the module when removed from the operative position out through the housing opening.

36. The ionizer of claim 35 wherein the slide-guide structure includes a plurality of pairs of spaced horizontal posts.

37. The ionizer of claim 35 wherein the slide-guide structure includes a plate on a wall of the housing and spaced elements mounted on the plate defining upper and lower guide surfaces of a module guide slot.

38. The ionizer of claim 37 wherein the slide-guide structure includes a pair of opposing guide rails into and along which side edges of the platter slide to and from the operative position, wherein the housing opening defines an elongate slot, and the guide rails are aligned with the slot, and wherein the module includes first and second handles attached to the support platter, and the elongate slot has enlarged openings at opposite ends thereof configured to receive therein the first and second handles.

39. The ionizer of claim 37 wherein the housing opening comprises an elongate slot through which the module passes when moved to and from the operative position, and the elongate slot is positioned in a forward panel of the housing.

40. The ionizer of claim 37 further comprising a card-edge connector in the housing, and the module when in the operative position being operatively plugged into the card-edge connector.

41. The ionizer of claim 37 wherein the at least two emitter points include first and second emitter points, and the module includes first and second contact members on the support platter and in electrical contact with the first and second emitter points, respectively.

42. The ionizer of claim 41 further comprising (a) first and second opposing walls which support the slide-guide structure, (b) a first electrical contact spring supported by the first wall and in electrical contact with the first contact member when the module is in the operative position and (c) a second electrical contact spring supported by the second wall and in electrical contact with the second contact member when the module is in the operative position.

43. An electrical ionizer, comprising:

a support platter having an air passage opening;

first and second emitter points supported by the support platter and operatively positioned relative to the air passage opening;

a first contact member supported by the support platter and electrically connected to the first emitter point;

a second contact member supported by the support platter and electrically connected to the second emitter point;

a fan;

first and second support assemblies disposed to support the support platter therebetween and in an operative position such that the fan when operated creates an air flow through the air passage opening and relative to the first and second emitter points;

a first electrical contact unit supported by the first support assembly and with the support platter in the operative position being in electrical contact with the first contact member; and a second electrical contact unit supported by the second support assembly and with the support platter in the operative position being in electrical contact with the second contact member.

44. The ionizer of claim 43 wherein the first and second electrical contact units are each in spring bias contact with the first and second contact members when the support platter is in the operative position.

45. The ionizer of claim 43 wherein the first and support assemblies include respective first and second slide-guide structures along which the platter slides to and from the operative position.

46. The ionizer of claim 45 wherein the slide-guide structures include pairs of spaced horizontal posts.

47. The ionizer of claim 43 wherein the first and second support assemblies include respective first and second circuit boards, and wherein the first electrical contact unit includes a first spring arm mounted to the first circuit board on an interior surface thereof, and the second electrical contact unit includes a second spring arm mounted to the second circuit board on an interior surface thereof.

48. An installation method, comprising the steps of:

providing an electrical ionizer including a housing having an opening, a fan disposed in the housing, and a first electrical connector disposed in the housing;

providing an electrical ionizer module including a support platter having an air passage opening therethrough, at least two emitter points supported by the support platter so as to extend into the opening, and a second electrical connector supported by the support platter and in electrical communication with at least one of the emitter points; and inserting the module into the housing through the housing opening and into an operative position wherein the air passage opening is operatively disposed relative to the fan and the second electrical connector is operatively connected to the first electrical connector.

* * * * *